US008899087B2

(12) United States Patent
Kaneda

(10) Patent No.: US 8,899,087 B2
(45) Date of Patent: Dec. 2, 2014

(54) HIGH STRENGTH, HIGH CARBON STEEL WIRE AND METHOD OF PRODUCING THE SAME

(75) Inventor: Akihiro Kaneda, Nasushiobara (JP)

(73) Assignee: Bridgestone Corporation, Tokyo (JP)

( * ) Notice: Subject to any disclaimer, the term of this patent is extended or adjusted under 35 U.S.C. 154(b) by 599 days.

(21) Appl. No.: 12/440,687

(22) PCT Filed: Sep. 14, 2007

(86) PCT No.: PCT/JP2007/067961

§ 371 (c)(1),
(2), (4) Date: Apr. 2, 2009

(87) PCT Pub. No.: WO2008/032829

PCT Pub. Date: Mar. 20, 2008

(65) Prior Publication Data

US 2010/0050728 A1 Mar. 4, 2010

(30) Foreign Application Priority Data

Sep. 14, 2006 (JP) ..... 2006-249322

(51) Int. Cl.

| | |
|---|---|
| ***B21C 1/00*** | (2006.01) |
| ***D07B 1/06*** | (2006.01) |
| ***C21D 8/06*** | (2006.01) |
| *B21C 1/04* | (2006.01) |

(52) U.S. Cl.

CPC ..... *C21D 8/065* (2013.01); *D07B 2205/3057* (2013.01); *B21C 1/00* (2013.01); *D07B 1/066* (2013.01); *D07B 2205/3035* (2013.01); *D07B 2201/2009* (2013.01); *C21D 2211/009* (2013.01)

USPC ..... 72/274; 72/278; 72/282

(58) Field of Classification Search

CPC ..... B21C 1/22; B21C 1/04; B21C 1/006

USPC ..... 72/274, 278, 282

See application file for complete search history.

(56) References Cited

U.S. PATENT DOCUMENTS

| | | | | |
|---|---|---|---|---|
| 2,074,224 | A * | 3/1937 | Johnson | 72/42 |
| 2,413,220 | A * | 12/1946 | Elder et al. | 72/42 |
| 3,955,390 | A * | 5/1976 | Geary | 72/64 |
| 4,120,186 | A * | 10/1978 | Pamplin et al. | 72/278 |
| 5,189,897 | A * | 3/1993 | Lionetti et al. | 72/278 |
| 6,715,331 | B1 * | 4/2004 | Zelin et al. | 72/278 |
| 6,800,147 | B2 * | 10/2004 | Nagao et al. | 148/320 |
| 6,823,706 | B1 * | 11/2004 | Kaneko et al. | 72/278 |
| 7,575,646 | B2 * | 8/2009 | Hashimura et al. | 148/333 |
| 7,617,713 | B2 * | 11/2009 | Zelin | 72/467 |
| 7,850,793 | B2 * | 12/2010 | Nagao et al. | 148/320 |
| 7,861,507 | B2 * | 1/2011 | Maekawa et al. | 57/212 |
| 2003/0066575 | A1 | 4/2003 | Nagao et al. | |
| 2004/0129354 | A1 * | 7/2004 | Nagao et al. | 148/598 |
| 2006/0130946 | A1 * | 6/2006 | Minamida et al. | 148/595 |
| 2009/0308503 | A1 * | 12/2009 | Tyl | 148/595 |
| 2010/0034691 | A1 * | 2/2010 | Yoshihara | 420/91 |
| 2010/0126643 | A1 * | 5/2010 | Yamasaski et al. | 148/599 |
| 2010/0175795 | A1 * | 7/2010 | Choi et al. | 148/598 |
| 2010/0212786 | A1 * | 8/2010 | Yamasaki et al. | 148/595 |
| 2010/0239884 | A1 * | 9/2010 | Manabe et al. | 428/659 |
| 2010/0263772 | A1 * | 10/2010 | Lee | 148/598 |
| 2011/0114231 | A1 * | 5/2011 | Vanoverberghe et al. | 148/596 |
| 2011/0168302 | A1 * | 7/2011 | Takahashi et al. | 148/598 |
| 2011/0206552 | A1 * | 8/2011 | Shimizu | 420/99 |
| 2011/0229718 | A1 * | 9/2011 | Nishida et al. | 428/379 |

FOREIGN PATENT DOCUMENTS

| | | | |
|---|---|---|---|
| JP | 06-312209 | A | 11/1994 |
| JP | 06-312210 | A | 11/1994 |
| JP | 07-197390 | A | 8/1995 |
| JP | 7-305285 | A | 11/1995 |
| JP | 11-241280 | A | 9/1999 |
| JP | 2000-087186 | A | 3/2000 |
| JP | 2000-219938 | A | 8/2000 |
| JP | 2004-091912 | A | 3/2004 |
| JP | 2005-002413 | A | 1/2005 |

OTHER PUBLICATIONS

Japanese Office Action issued in Japanese Application No. 2006-249322 dated Sep. 4, 2012.

Extended European Search Report issued in European Application No. 07807365.7 dated Dec. 19, 2012.

Japanese Office Action issued in Application No. 2006-249322 dated Jun. 12, 2012.

* cited by examiner

*Primary Examiner* — Shelley Self
*Assistant Examiner* — Lawrence Averick
(74) *Attorney, Agent, or Firm* — Sughrue Mion, PLLC

(57) ABSTRACT

The present invention provides a method which enables a steel wire to be highly strengthened with maintaining good ductility. Specifically, the present invention provides a method comprising: subjecting a high carbon steel wire material having carbon content of 0.85 to 1.10 mass % to a pre-stage drawing process with a predetermined magnitude of drawing, to form an intermediate wire material; subjecting the intermediate wire material formed by the pre-stage drawing process to a patenting treatment in which tensile strength of the wire material is adjusted to a range of 1323 to 1666 MPa; then subjecting the patented steel wire material to a subsequent drawing process including the final drawing.

2 Claims, No Drawings

HIGH STRENGTH, HIGH CARBON STEEL WIRE AND METHOD OF PRODUCING THE SAME

CROSS REFERENCE TO RELATED APPLICATIONS

This application is a National Stage of International Application No. PCT/JP2007/067961 filed Sep. 14, 2007, claiming priority based on Japanese Patent Application No. 2006-349322 filed Sep. 14, 2006, the contents of all of which are incorporated herein by reference in their entirety.

TECHNICAL FIELD

The present invention relates to a method of producing a high strength, high carbon steel wire as a component of a steel cord or the like for use as a reinforcing member of a rubber product such as a tire, a belt or the like.

PRIOR ART

A high carbon steel wire for use in a filament of a steel cord or the like is generally produced by a series of processes of: employing as a material a high carbon steel wire material having diameter of approximately 5.5 mm, containing 0.70-0.95 mass % of carbon and being subjected to patenting process such as Stermor process to have a perlite structure; subjecting the high carbon steel wire material to at least one drawing-heating process in which the high carbon steel wire material is drawn to have a predetermined intermediate wire diameter by dry drawing and then patented; subjecting the high carbon steel wire material thus treated to the final heating process to adjust the structure thereof to the perlite structure; and wet-drawing the steel wire material to have a predetermined wire diameter.

For example, there has been a demand for a steel cord having higher specific strength in order to reduce the weight of a tire in which a steel cord is applied as a reinforcing material. Accordingly, regarding a high carbon steel wire for use as a filament of such a steel cord, there has been a demand for a high carbon steel wire having higher tensile strength.

The diameter of a high carbon steel wire for use as a filament of a steel cord is generally 0.10-0.60 mm or so. When the diameter of such a steel wire is to be kept constant, in order to enhance tensile strength of the wire, there have been applied solutions including using a material having a relatively high carbon content, making a magnitude of drawing during the final drawing process relatively high by increasing the diameter of the intermediate wire material supplied to the final heat treatment, and the like.

In producing such a high strength steel wire having relatively high tensile strength as described above, there arises a problem of deterioration of ductility caused by high increase in strength. Such deteriorated ductility results in increase in wire fracture in producing a steel cord by twining steel wires and poorer fatigue resistance. In order to suppress deterioration of ductility caused by increase in strength described above, there have been proposed improving raw materials (JP 6-312209), improving conditions of the wet drawing process as the final drawing process (JP7-197390).

DISCLOSURE OF THE INVENTION

Problems to be Solved by the Invention

As described above, improvements for suppressing deterioration of ductility caused by increase in strength have been made in view of the raw materials or the final drawing process. Specifically, JP 6-312209 points out that pro-eutectoid ferrite and the pro-eutectoid cementite as uneven structures may cause deterioration of ductility after the wire drawing and proposes as solutions modifying the components, the patenting process and the final drawing of the wire. On the other hand, JP7-197390 seeks a solution limited to improvements obtained by evenly achieving the final drawing process. However, neither JP 6-312209 nor JP7-197390 has achieved sufficient effects in this regard.

Therefore, an object of the present invention is to provide a method which can solve the problems of the conventional techniques as described above and achieve highly strengthening a steel wire with maintaining good ductility thereof.

Means for Solving the Problems

The inventor of the present invention has discovered that the conditions in the pre-stage drawing process for obtaining an intermediate wire material to be served for the final heating process significantly affect the ductility of a steel wire finally obtained.

Specifically, although a high carbon steel wire material as a material, which has been subjected to Stermor process, is basically constituted of perlite structures, the steel wire material generally includes at least to some extent unevenness in the macro components due to center segregation, surface decarburization and the like and/or unevenness in the micro components such as pro-eutectoid ferrite and pro-eutectoid cementite.

Although the unevenness in the macro and/or micro components as described above is alleviated to some extent at some stage prior to the final heat treatment process, it remains as unevenness in metal structures of a steel wire finally obtained and may act as a nucleus of fracture. The higher tensile strength of a steel wire, or more specifically, when the tensile strength Z (MPa) and the diameter Df of a high strength steel wire are in ranges which satisfy the formula (2) below, the more significantly the unevenness in metal structure affects the ductility of the high strength steel wire. For example, the unevenness in metal structure significantly affects ductility of a high strength, high carbon steel wire of which diameter is 0.18 mm and tensile strength exceeds 3300 MPa.

$$Z \geq 2250 - 1450 \log Df \quad (2)$$

In particular, when the tensile strength Z of a high strength steel wire is within a range satisfying $Z \geq 2843 - 1450 \log Df$, unevenness in metal structure more significantly affects ductility of the steel wire.

It should be noted that the aforementioned range of tensile strength Z corresponds to a range of tensile strength Z required for ensuring high strength necessitated by a steel wire as a reinforcing member of a tire. Specifically, the larger wire diameter results in the higher strength against fracture. However, in the case of an extra-high strength material, the larger wire diameter results in more difficulty in producing the wire. The aforementioned range of tensile strength Z thus corresponds to a range which allows relatively high fracture strength, while keeping the production relatively easy.

Regarding the unevenness in metal structure which remains in the finally obtained steel wire, the larger the magnitude of drawing in the pre-stage drawing process conducted prior to the final heat treatment, the more significantly the unevenness is mitigated. However, in order to obtain a steel wire having relatively high tensile strength by using the same material and maintaining the same diameter, it is necessary to increase the magnitude of drawing at the final drawing process. To make it possible, it is necessary to make the diameter of an intermediate wire material fed to the final heat treatment relatively large, which inevitably requires setting the magnitude of drawing at the pre-stage drawing process relatively small. In short, the more the tensile strength of a steel wire is increased, the more it is likely that the unevenness in metal structure will remain in the steel wire.

Further, pro-eutectoid ferrite present at the stage of a material decreases as the carbon content increases. Therefore, increasing the carbon content is effective in mitigating unevenness in metal structures. However, increased carbon content facilitates precipitation of pro-eutectoid cementite, causing deterioration of ductility of a steel wire.

In view of the discoveries described above, the inventor of the present invention keenly studied the optimum conditions in the pre-stage drawing process, to complete the present invention. A non-limiting embodiment of the present invention includes a method of producing a high strength, high carbon steel wire. The method includes subjecting a high carbon steel wire material having carbon content of 0.85 to 1.10 mass % to a pre-stage drawing process in which a magnitude of drawing $\epsilon$ as defined in formula (1) below is no smaller than 2.5, to form an intermediate wire material; subjecting the intermediate wire material formed by the pre-stage drawing process to a patenting treatment in which tensile strength of the wire material is adjusted to a range of 1323 to 1666 MPa; then subjecting the patented steel wire material to a subsequent drawing process including the final drawing.

$$\epsilon=2\cdot\ln(D0/D1) \quad (1)$$

In the formula above,

D0: Diameter (mm) of a steel wire material on the inlet side of the pre-stage drawing D1: Diameter (mm) of an intermediate wire material on the outlet side of the pre-stage drawing The high carbon steel wire material has perlite structures.

The carbon content of the high carbon steel wire material is in a range of 0.95 to 1.05 mass %.

The patenting treatment is to adjust tensile strength of the steel wire to a range of 1421 to 1550 MPa.

Effect of the Invention

According to the present invention, a magnitude of drawing $\epsilon$ during the pre-stage drawing process is made no smaller than 2.5 to alleviate unevenness in metal structures, whereby a steel cord can be highly strengthened without sacrificing ductility.

Best Mode of Implementing the Invention

Next, a method of producing a high strength, high carbon steel wire of the present invention will be described in detail. First, a high carbon steel wire material having carbon content of 0.85-1.10 mass % is used as a forming material. The carbon content is set at 0.85 mass % or more because, when finished steel wires are to have the same tensile strength, a steel cord having the larger carbon content allows the smaller magnitude of the final drawing process, i.e. the larger magnitude of the pre-stage drawing process. However, since a too high carbon content facilitates precipitation of pro-eutectoid ferrite in the grain boundary and tends to cause unevenness in metal structures, the carbon content is set at 1.10 mass % or less. It is preferable that the carbon content is set in a range of 0.95 to 1.05 mass %.

The high carbon steel wire material is made into an intermediate wire material by the pre-stage drawing process, and the resulting intermediate wire material is subjected to a patenting process. Here, it is essential that a magnitude of drawing $\epsilon$ during the pre-stage drawing process, as defined in formula (1) below, should be made no smaller than 2.5.

$$\epsilon=2\cdot\ln(D0/D1) \quad (1)$$

In the formula above,

D0: Diameter (mm) of a steel wire material on the inlet side of the pre-stage drawing D1: Diameter (mm) of an intermediate wire material on the outlet side of the pre-stage drawing Specifically, unevenness in metal structures, in particular, is alleviated by making a magnitude of drawing $\epsilon$ during the pre-stage drawing process no smaller than 2.5 because, when the magnitude of drawing $\epsilon$ is no smaller than 2.5, lamellas are substantially aligned in the machine direction and the area of metal structures at a cross section is reduced to approximately ⅓, whereby unevenness in the structures is made relatively small. The larger the magnitude of drawing during the pre-stage drawing process is, the more significantly the unevenness is alleviated. However, since targeting a too large magnitude during the pre-stage drawing process makes the pre-stage drawing process difficult, it is preferable to make the magnitude during the pre-stage drawing process no larger than 3.5.

The intermediate wire material, which has been treated by the pre-stage drawing process, is subjected to a patenting process to adjust tensile strength thereof to a range of 1323 to 1666 MPa. When finished steel wires are to have the same tensile strength, the higher tensile strength of a steel cord after being treated by the heat treatment process allows making the magnitude of drawing during the subsequent-stage drawing process smaller, i.e. making the magnitude of drawing during the pre-stage drawing process larger. Therefore, the tensile strength of the intermediate wire material is adjusted to 1323 MPa or higher. It should be noted that the tensile strength of a wire material after being treated by a heat treatment process can be controlled by changing the perlite transformation temperature. Increasing tensile strength of a wire material containing 0.85 to 1.10 mass % carbon to that exceeding 1666 MPa necessitates lowering the perlite transformation temperature, which facilitates precipitation of bainite to cause unevenness in metal structures. Therefore, tensile strength of a wire material is made no higher than 1666 MPa and preferably in a range of 1421 to 1550 MPa.

Thereafter, the patented steel wire is subjected to a subsequent-stage drawing process including the final drawing process. There is no need to set particular restriction on the subsequent-stage drawing process. By completing the processes described above, a high strength, a high carbon steel wire having tensile strength (MPa) which satisfies the aforementioned formula (2) and thus possessing sufficient strength as a reinforcing member of a tire can be obtained.

It is preferable that diameter of a steel wire is preferably in a range of 0.10 to 0.60 mm. When the diameter of a steel wire is smaller than 0.10 mm, the wire is too thin to obtain the required high strength even in a twined state. When the diameter of a steel wire exceeds 0.60 mm, the diameter of the patented wire material prior to the final drawing process is relatively thick and thus it becomes difficult to increase a magnitude of drawing $\epsilon$ at the pre-stage dry drawing process. Further, when the diameter of a steel wire exceeds 0.60 mm, the steel wire is more distorted, as compared with a steel wire having the same curvature and of which diameter is 060 mm or smaller, and is not useful in practice.

EXAMPLES

Steel wires as shown in Table 1 and Table 2 were produced by: subjecting respective steel wire materials having carbon contents and diameters as shown in Table 1 and Table 2 to a pre-stage drawing process and then a heat treatment under the conditions as shown in Table 1 and Table 2; and subjecting the respective steel wire materials thus treated to a subsequent-stage drawing process (the final drawing) under the conditions as shown in Table 1 and Table 2. A magnitude of the subsequent-stage drawing in Table 1 was calculated in accordance with the aforementioned formula (1) for obtaining a magnitude of drawing during the pre-stage drawing.

In the materials having the same carbon content, the tensile strength of the respective steel wires after being treated by the heat treatment was adjusted by changing the temperature of the patenting process. When the temperature at the patenting process is the same, the higher carbon content results in the higher tensile strength.

With regard to the respective steel wires thus obtained, tensile strength and torsional properties were evaluated. The results thereof are shown in Table 1 and Table 2, with other data. The measurement of tensile strength was carried out in accordance with the tensile strength test prescribed in JIS Z2241. The torsional properties were obtained by: applying a tensile strength of 196 MPa to each of the steel wires by using a weight according to a sectional area of the steel wire; twisting a portion of each steel wire, having a length of 100 mm, in the tensile strength-loaded state; converting the number of the above twisting counted before fracture of the steel wire into the number of twisting a portion of the steel wire, having a length corresponding to 100 d (d: diameter); and expressing the results thereof as an index, with the number counted in the prior art being 100.

TABLE 1

| | Prior Art 1 | Prior Art 2 | Prior Art 3 | Example 1 | Example 2 | Example 3 | Example 4 | Example 5 | Example 6 |
|---|---|---|---|---|---|---|---|---|---|
| C content (mass %) of steel wire material | 0.82 | 0.92 | 0.82 | 0.85 | 0.96 | 0.92 | 0.92 | 0.92 | 1.02 |
| Diameter (mm) of steel wire material | 5.5 | 5.5 | 5.5 | 5.5 | 5.5 | 6.0 | 5.5 | 6.0 | 5.5 |
| Diameter (mm) of intermediate wire material | 1.74 | 1.74 | 1.74 | 1.70 | 1.47 | 1.50 | 1.50 | 1.50 | 1.42 |
| magnitude of drawing ϵ during the pre-stage drawing process | 2.30 | 2.30 | 2.30 | 2.34 | 2.64 | 2.81 | 2.60 | 2.77 | 2.71 |
| Tensile strength (MPa) of wire material after the heat treatment | 1284 | 1395 | 1264 | 1323 | 1421 | 1422 | 1382 | 1392 | 1500 |
| magnitude of drawing during the final drawing process | 3.52 | 3.52 | 4.54 | 4.49 | 4.20 | 4.20 | 4.24 | 4.24 | 4.13 |
| Diameter (mm) of steel wire | 0.30 | 0.30 | 0.18 | 0.18 | 0.18 | 0.18 | 0.18 | 0.18 | 0.18 |
| Tensile strength (MPa) of steel wire | 3352 | 3440 | 4215 | 4225 | 4252 | 4265 | 4251 | 4280 | 4250 |
| Tosional properties | | | 100 | 130 | 180 | 190 | 130 | 140 | 190 |

TABLE 2

| | Comparative Example 1 | Comparative Example 2 | Comparative Example 3 | Example 7 | Example 8 | Example 9 | Example 10 |
|---|---|---|---|---|---|---|---|
| C content (mass %) of steel wire material | 1.09 | 1.02 | 0.96 | 1.02 | 1.02 | 1.09 | 1.09 |
| Diameter (mm) of steel wire material | 5.5 | 5.5 | 5.5 | 6.0 | 6.0 | 5.5 | 6.0 |
| Diameter (mm) of intermediate wire material | 1.35 | 1.42 | 1.47 | 1.42 | 1.42 | 1.35 | 1.35 |
| magnitude of drawing ϵ during the pre-stage drawing process | 2.80 | 2.71 | 2.64 | 2.88 | 2.88 | 2.81 | 2.98 |
| Tensile strength (MPa) of wire material after the heat treatment | 1680 | 1667 | 1660 | 1510 | 1550 | 1545 | 1580 |

TABLE 2-continued

| | Comparative Example 1 | Comparative Example 2 | Comparative Example 3 | Example 7 | Example 8 | Example 9 | Example 10 |
|---|---|---|---|---|---|---|---|
| magnitude of drawing ϵ during the final drawing process | 4.03 | 4.20 | 4.13 | 4.13 | 4.13 | 4.03 | 4.03 |
| Diameter (mm) of steel wire | 0.18 | 0.18 | 0.18 | 0.18 | 0.18 | 0.18 | 0.18 |
| Tensile strength (MPa) of steel wire | 4261 | 3871 | 3563 | 4250 | 4285 | 4272 | 4290 |
| Tosional properties | 50 or less (*) | 50 or less (*) | 50 or less (*) | 200 | 190 | 140 | 150 |

(*) Delamination occurred: Cracks were generated in steel cord in the twisting process.

The invention claimed is:

1. A method of producing a high strength wire, high carbon steel wire, characterized in that in said method comprises: subjecting a high carbon steel wire material having carbon content of 0.95 to 1.05 mass % to a pre-stage drawing process in which a magnitude of drawing epsilon as defined in formula (1) below is no smaller than 2.88, to form an intermediate wire material; subjecting the intermediate wire material formed by the pre-stage drawing process to a patenting treatment in which tensile strength of the wire material is adjusted to a range of 1421 to 1550 MPa; then subjecting the patented steel wire material to a subsequent drawing process including the final drawing, $$\text{Epsilon}=2*\ln(D0/D1) \qquad \text{Formula (1)}$$

In the formula above,

D0: Diameter (mm) of a steel wire material on the inlet side of the pre-stage drawing D1: Diameter (mm) of an intermediate wire material on the outlet side of the pre-stage drawing.

2. The method of producing a high strength, high carbon steel wire of claim 1, wherein the high carbon steel wire material has perlite structures.

* * * * *